US012655567B2

(12) United States Patent
Saccocci

(10) Patent No.: US 12,655,567 B2
(45) Date of Patent: Jun. 16, 2026

(54) DOOR-LOCK DEVICE

(71) Applicant: Elbi International S.p.A., Turin (IT)

(72) Inventor: Andrea Saccocci, Turin (IT)

(73) Assignee: Elbi International S.p.A., Turin (IT)

( * ) Notice: Subject to any disclaimer, the term of this patent is extended or adjusted under 35 U.S.C. 154(b) by 85 days.

(21) Appl. No.: 18/743,151

(22) Filed: Jun. 14, 2024

(65) Prior Publication Data

US 2024/0417909 A1 Dec. 19, 2024

(30) Foreign Application Priority Data

Jun. 14, 2023 (IT) ..... 102023000012204

(51) Int. Cl.
*D06F 37/28* (2006.01)

(52) U.S. Cl.
CPC ..... *D06F 37/28* (2013.01)

(58) Field of Classification Search
CPC ..... D06F 37/28
USPC ..... 68/12.26
See application file for complete search history.

(56) References Cited

U.S. PATENT DOCUMENTS

2004/0083769 A1* 5/2004 Kim ..... D06F 39/14 134/58 DL
2018/0008120 A1 1/2018 Dirnberger
2019/0309542 A1 10/2019 Wang

FOREIGN PATENT DOCUMENTS

| | | |
|---|---|---|
| CN | 104099753 | 1/2016 |
| DE | 102020210745 | 3/2021 |
| EP | 2369050 | 9/2011 |
| EP | 2726690 | 1/2018 |

OTHER PUBLICATIONS

Rapporto di Ricerca e l'Opinione Scritta [Search Report and Written Opinion] Dated Dec. 13, 2023 From the Ministero Delle Imprese e Del Made in Italy, Direzione Generale Sviluppo Produttivo e Competititivita, Ufficiao Italiano Brevetti e Marchi Re. Application No. IT202300012204. (32 Pages).

* cited by examiner

*Primary Examiner* — Tinsae B Ayalew

(57) ABSTRACT

The present invention concerns door-lock device (1) for a door of a household appliance having a door and a prong (N) associated with said door, wherein said door-lock device (1) comprises: a containment casing (2); a blocking assembly (3) arranged in said containment casing (2), which includes a blocking slider (32), constrained to slide between a retracted position and an extracted position, wherein said blocking slider (32) is arranged to interfere with a prong (N) when the door is opened; and an electric module (4) comprising a blocking pin (41), wherein said blocking pin (41) is capable of assuming an unlocking position on command, and a blocking position to hold said blocking slider (32) in said blocking position. Wherein, the door-lock device comprises a damping assembly (5) having a safety member or pin (52), arranged so as to limit the sliding of said blocking slider (32) when said blocking slider (32) is strained by said prong (N) to move from said extracted position to said retracted position and said blocking pin (41) is in said blocked position.

The present invention also concerns a household appliance, such as a washing machine and the like.

7 Claims, 3 Drawing Sheets

DOOR-LOCK DEVICE

RELATED APPLICATION(S)

This application claims the benefit of priority of Italy Patent Application No. 102023000012204 filed on Jun. 14, 2023, the contents of which are incorporated by reference as if fully set forth herein in their entirety.

FIELD AND BACKGROUND OF THE INVENTION

The present invention concerns an improved door-lock device.

More specifically, the invention concerns a door-lock device for blocking the door of a hatch of a household appliance, for example a washing machine, capable of ensuring the unlocking and the opening of the door itself, even in the case of intense stress from the inside of the household appliance itself.

In the following the description will be directed to a door-lock device for a washing machine, but it is clear that it should not be considered limited to this specific use.

As it is well known, modern washing machines currently have increasingly larger drums. This allows washing large quantities of very bulky cloths, such as duvets and similar, which previously often had to be washed by hand.

The washing machine baskets are closed by doors, which are kept closed and blocked by a door-lock device. Typically a door-lock device comprises a mechanical lock assembly, having a blocking slider, configured to move from a retracted position to an extended operational position, when the door prong, in the event of an attempt to open, interferes with the blocking slider; and an electrical module, connected and controlled by the household appliance's logic control unit, for activating a blocking pin. The blocking pin is designed to block the blocking slider when it is in the extracted position, to prevent the prong from disengaging from the door-lock device and therefore from opening the door without an opening command aimed at retracting the blocking pin being been generated.

It often happens that the drums of the modern washing machines are overfilled. This can cause considerable stress on the washing machine door from inside the drum. As an example, consider the case of washing a duvet. When the duvet is still dry it can cause significant stress on the door from inside the door. If it is wished to open the door, for example because it has been forgotten to insert an additional element in the basket, the stress from inside of the door acts on the kinematics of the blocking slider via the door prong, causing considerable friction between the slider itself and the blocking pin of the electrical module of the door-lock device. Therefore, there is a situation similar to that of an attempt to open in conditions of a blocked door but at a lower force than the maximum tolerable by the door-lock device (for example 200N versus 600N on the door).

Therefore, as mentioned above, there would be a situation similar to an attempt to open the basket from inside.

The stress on the blocking pin must therefore be overcome by the force of the actuator that moves the blocking pin and by the mechanical system that activates the electrical module, following a command from the washing machine.

To ensure sufficient force to the actuator, an actuator must be sized so that it can overcome any interference on the blocking pin from the locking slider. This involves the use of high-performance actuators, which has a considerable impact on production costs. For example, the permanent magnets or the solenoid used for the actuator must be appropriately sized and therefore become more expensive.

A different criterion for solving the technical problem described above is to "demultiply" the stress on the door prong, possibly using an interface cam with the door prong. However, this solution has the disadvantage of requiring an increase in the force necessary to open the door in conditions with the door unlocked. This, however, is in conflict with the requirement of the so-called "child safety", according to which the doors of household appliances (and in particular of washing machines) must have a limited opening force from the inside to allow an easy exit for any children who close themselves inside the washing machine drum (which, as mentioned, today is always larger, and therefore able to house a small child).

It appears evident that the solutions according to the prior art are expensive in both economic and safety terms.

In light of the above, it is therefore the aim of the present invention to propose a door-lock device capable of overcoming the limitations and technical problems of the prior art as described above.

Another object of the present invention is a door-lock device which can be compatible with the electrical modules of common door-lock devices.

SUMMARY OF THE INVENTION

It is specific object of the present invention a door-lock device for a door of a household appliance having a door and a prong associated with said door, wherein said door-lock device comprises: a containment casing; a blocking assembly arranged in said containment casing, which includes a blocking slider, constrained to slide between a retracted position and an extracted position, wherein said blocking slider is arranged to interfere with a prong when the door is opened; and an electric module comprising a blocking pin, wherein said blocking pin is capable of assuming an unlocking position on command, and a blocking position to hold said blocking slider in said blocking position; characterized by comprising a damping assembly having a safety member or pin, arranged so as to limit the sliding of said blocking slider when said blocking slider is strained by said prong (N) to move from said extracted position to said retracted position and said blocking pin is in said blocked position.

Always according to the invention, said damping assembly may comprise a safety slider constrained to said blocking slider, and arranged so as to interfere with said blocking pin when the blocking slider is forced by said prong to pass from said extracted position to said retracted position, and said safety pin may be constrained to said safety slider.

Still according to the invention, said safety slider comprises a tooth, said containment casing comprises a groove, and said safety pin has a sliding guide, in which said tooth of said safety slider is constrained to slide, wherein, when said blocking slider is urged by said prong, said safety pin is moved so as to interfere with said groove to block the sliding of said blocking slider.

Still according to the invention, said groove may have a side abutment wall, and said safety pin may block the sliding of said blocking slider by abutting on said side abutment wall.

Advantageously according to the invention, said damping assembly may comprise a returning member, such as a spring, interposed between said blocking slider and the safety pin, to oppose the movement of said safety pin when said blocking slider is strained by said prong to pass from said extracted position to said retracted position.

Further according to the invention, said blocking assembly may comprise a rotating hook intended to engage with said prong associated with the door of said household appliance when said blocking slider is in said extracted position.

It is further object of the present invention a household appliance, such as a washing machine and the like, comprising a door having an associated prong, a logic control unit, and a door-lock device according to any one of the preceding claims, wherein said control logic unit is operatively connected to said electric module of said door-lock device to actuate said blocking pin on command.

Always according to the invention, said household appliance may comprise a drum for containing clothes to be washed, and said door may be capable of closing said drum.

BRIEF DESCRIPTION OF THE SEVERAL VIEWS OF THE DRAWINGS

The present invention will be now described, for illustrative but not limitative purposes, according to its preferred embodiments, with particular reference to the figures of the enclosed drawings, wherein.

DESCRIPTION OF SPECIFIC EMBODIMENTS OF THE INVENTION

In the various figures the similar parts will be indicated with the same reference number.

Figure 1:
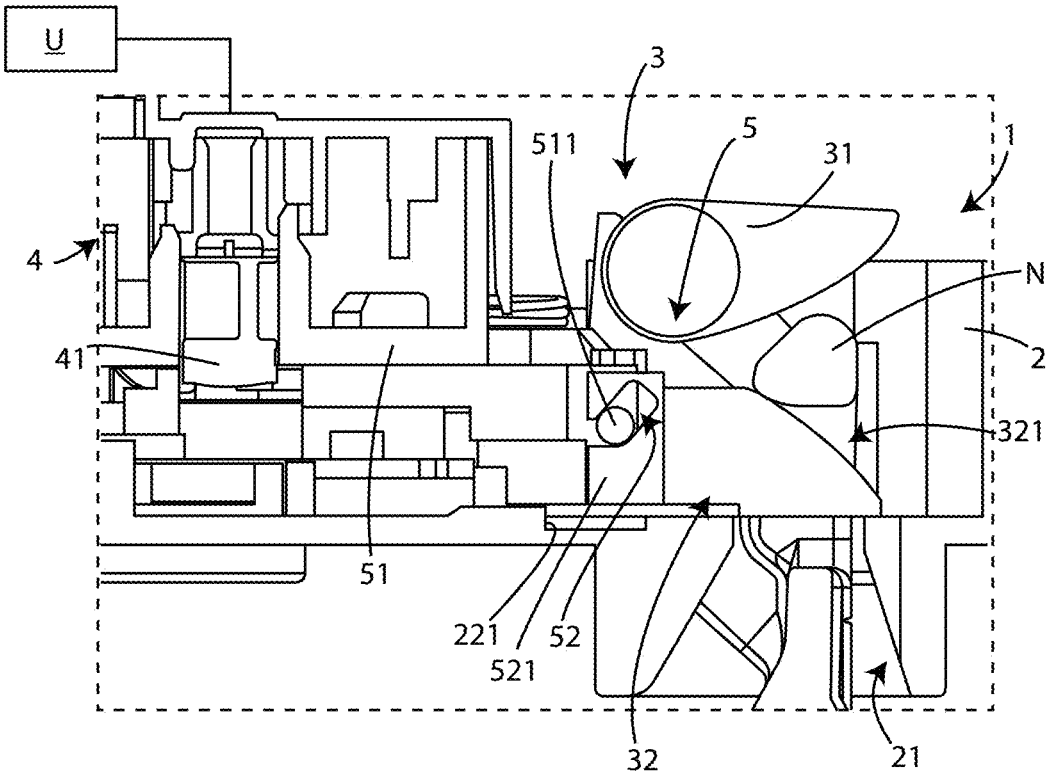
FIG. 1 shows a side sectional view of a door-lock device according to the invention when the household appliance door is in the closed position.
Figure 2:
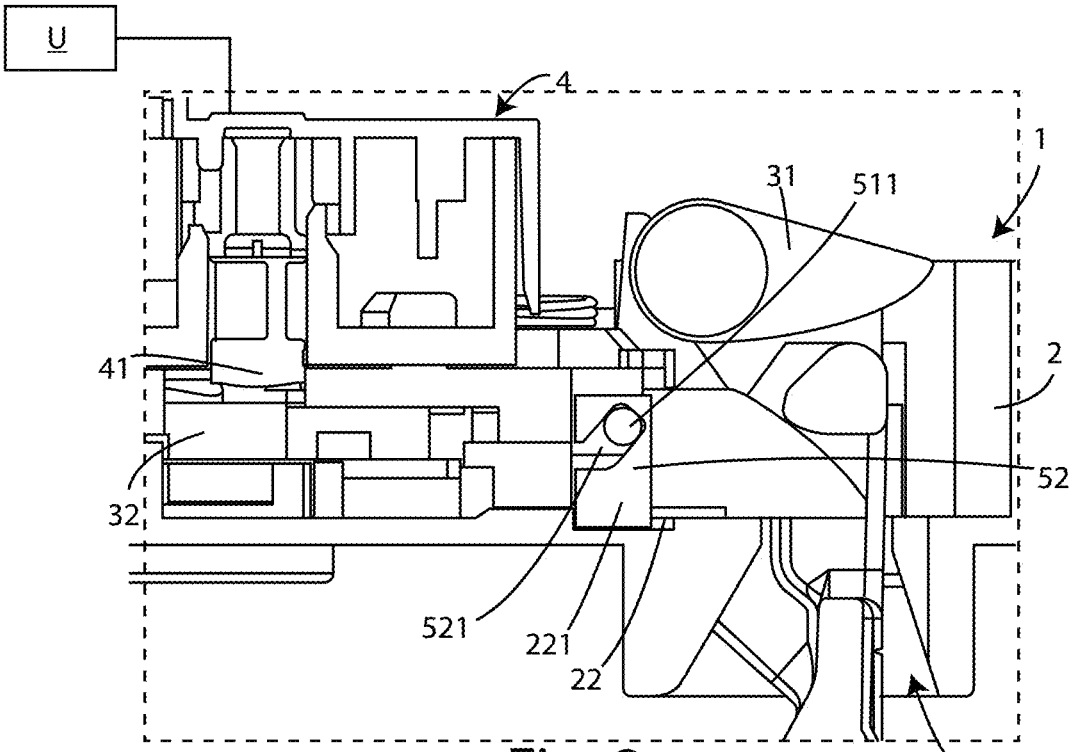
FIG. 2 shows a side sectional view of the door-lock device according to FIG. 1, in which a blocking slider is stressed by a force.

Referring to FIGS. 1 and 2, a side section of a door-lock device 1 according to the present invention is observed, in which a prong N of a door (not shown in the figure) of a washing machine (not shown in the figure) is inserted.

In particular, the door-lock device 1 essentially comprises a containment casing 2, a blocking assembly 3, an electrical module 4 and a damping assembly 5.

The containment casing 2 is intended to contain the other elements of the door-lock device 1. The containment casing 2 also has an opening 21, into which the prong N can be inserted when the door of the household appliance is closed, as shown in FIG. 1. The containment casing 2 also has a groove 22 on the internal surface. The groove 22 has a lateral abutment wall 221, the operation of which will be better explained below The blocking assembly 3 comprises a rotating hook 31, positioned in correspondence with the opening 21, capable of engaging with the prong N of the household appliance door to keep it closed.

The locking assembly 3 also comprises a blocking slider 32, capable of sliding between a retracted position and an extended position. In said extracted position, the blocking slider 32 is arranged so as to interfere with the prong N in the event that, when the door is closed, it should be opened.

The blocking slider 32 has a tapered surface 321, which interferes with the prong N when it is inserted into the door-lock device 1, so that, when the door is moved to be opened, a portion of the prong N interferes with said tapered surface 321, trying to slide the blocking slider 32 from the extracted position to the retracted one. Note that when the door is open (and therefore the prong N is completely released from the door-lock device 1, or when the door is completely and correctly closed) the prong N does not interfere with the blocking slider 32. The blocking slider 32 assumes the extracted position only when there is an attempt to open the door, thus causing interference between said prong N and said blocking slider 32.

The blocking slider 32 is held in the extended position by a spring (not shown in the figure).

The electrical module 4 is arranged substantially superimposed on said blocking slider 32. The electrical module 4 is operationally connected to the logic control unit U of the household appliance (not shown in the figure), and comprises a blocking pin 41. The blocking pin block 41 is able to assume, following an electrical command from said logic control unit U, an unlocked position, in which it does not interfere with the blocking assembly 3, and a blocked position, in which it holds the blocking slider 32 in the respective extracted position.

The damping assembly 5 comprises a safety slider 51 linked to said blocking slider 32, arranged so as to interfere with said blocking pin 41 when the blocking slider 32 is placed in the extracted position.

The damping assembly 5 also comprises a safety member or pin 52, connected to the safety slider 51 so as to limit the sliding of the blocking slider 52 when it is stressed by the prong N. In particular, the safety pin 52 has in the body a sliding guide 521, in which the tooth 511 of the safety slider 51 is forced to slide.

The shape of the sliding guide 521 is such as to cause the safety pin 52 to lower when the blocking slider 32 interferes with the prong N while it is in said extracted position and the blocking pin 41 is in the blocked position. In this way, the safety pin 52, while it translates dragged by the blocking slider 32, is positioned in correspondence with the groove 22 of the containment casing 2.

The damping assembly 5 also comprises a return member, which in particular in the present embodiment is a return spring 53 (see FIG. 3), placed between the blocking slider 32 and the safety pin 52.

The return spring 53 is arranged so as to counteract the movement of the safety pin 52 when it is inserted into the groove 22.

The operation of the door-lock device 1 described above is as follows.

When the door of the household appliance, for example a washing machine, is in the closed position, as shown in FIG. 1, the prong N is inserted into the door-lock 1, and in particular through the opening 21 of the containment casing 2. Furthermore, the blocking hook 31 is rotated and the blocking slider 32 is in the extended position.

The blocking pin 41 is therefore free to move. In this way, following a command coming from the logic control unit U of the washing machine, the blocking pin 41 can move from the unlocked position to the locked position, in which it prevents the opening of the door.

Figure 3:
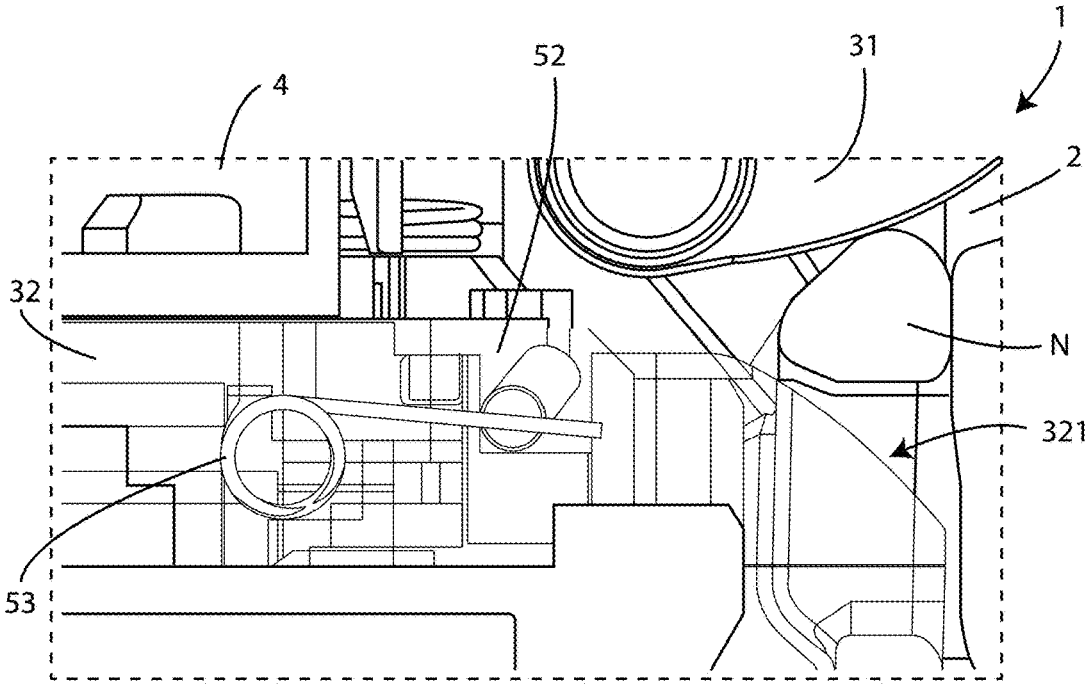
FIG. 3 shows a side sectional view of a detail of the door-lock device according to FIG. 1.

Referring now to FIGS. 2 and 3, in the event that the basket was too full, e.g., when it contains a dry down jacket, such as to urge the door from the inside to open, with a high force but not sufficient to open the hatch, the prong N interferes with the tapered surface 321 of the blocking slider 32, causing it to move from the extracted position. At the same time, the safety slider 51, dragged by the blocking slider 32, comes into contact with said safety pin 41. At the same time, the safety pin 52 is positioned in correspondence with the groove 22 of the containment casing 2. Due to the interaction between the sliding guide 521 and the tooth 511, the safety pin 52 is lowered and fits into the groove itself.

In case of the blocking slider 32 were to continue to slide due to the aforementioned stress, the safety pin 52 would limit its movement by abutting the lateral abutment wall 221, thus limiting the travel of the blocking slider 32 and any interference with the safety pin 41 by the safety slider 51. In this way, the safety pin 41 is not stressed too much, such that, in the event that the user needs to open the door, the unlocking of the door would not be prevented and the safety pin 41 could easily switch from the locked to the unlocked position.

Figure 4:
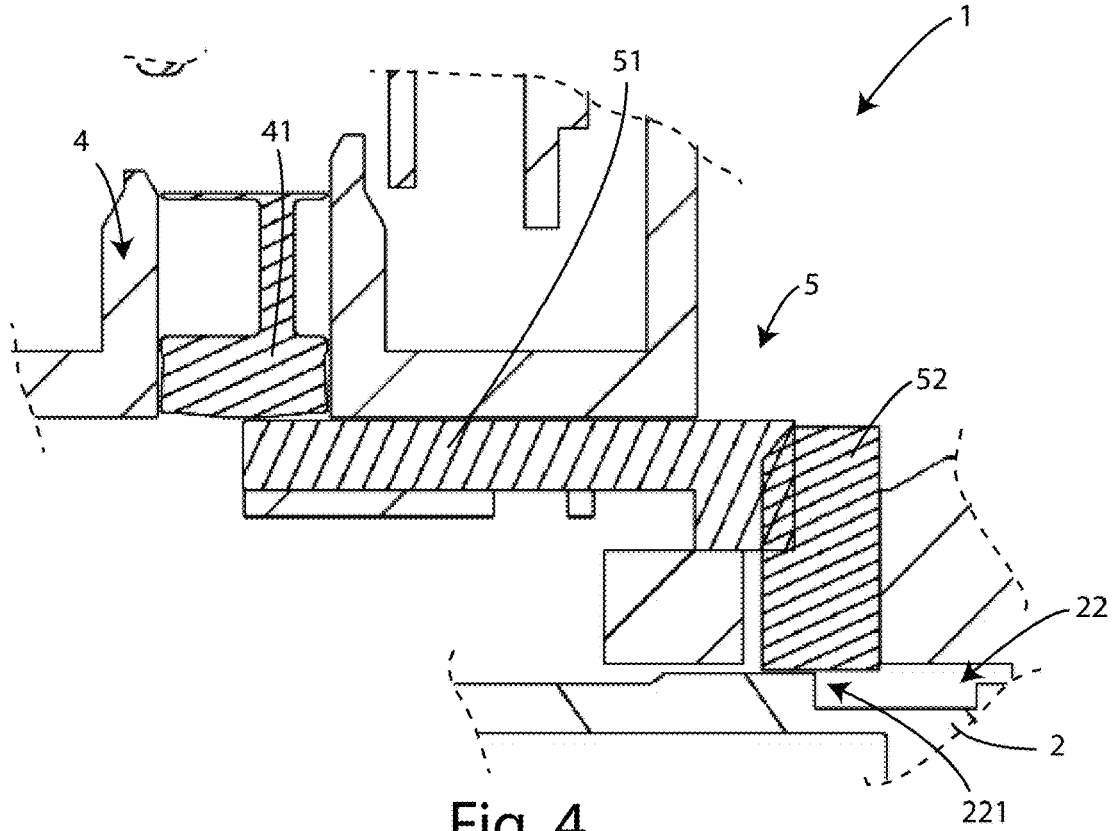
FIG. 4 shows a schematic view of a door-lock device according to the present invention in the unlocked position.
Figure 5:
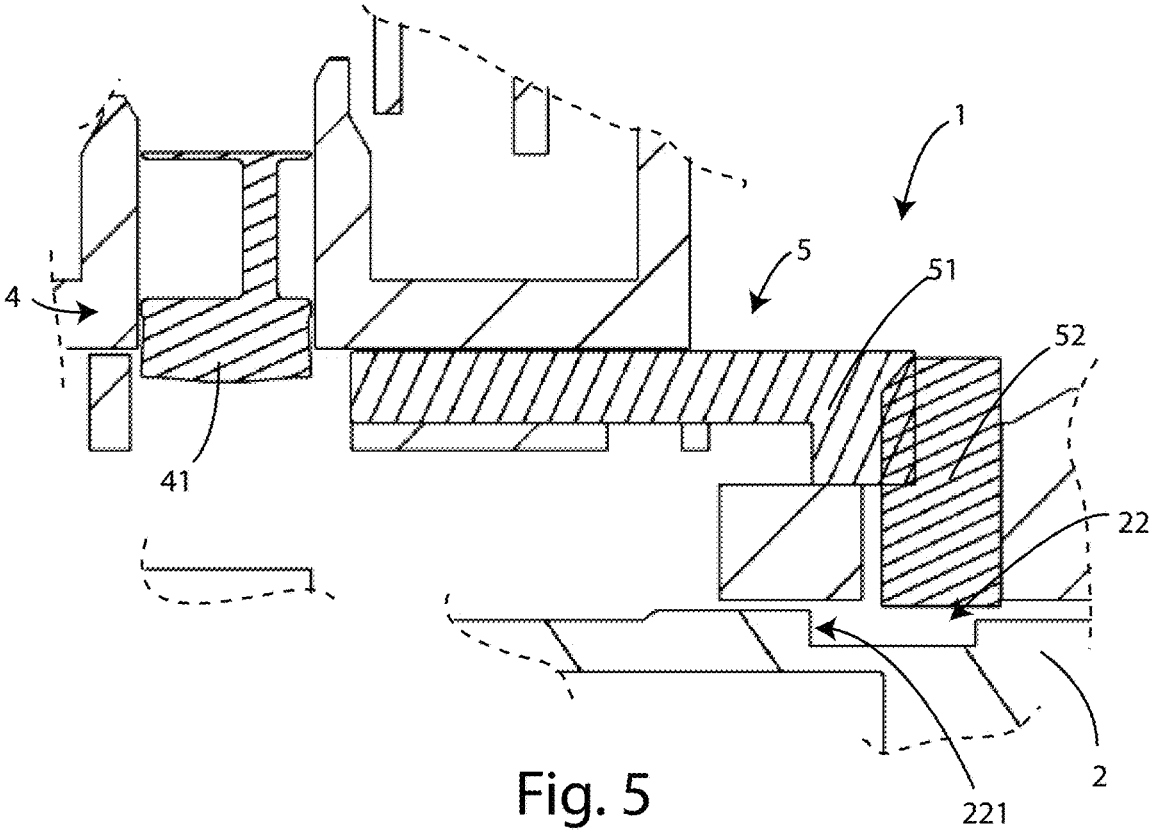
FIG. 5 shows a schematic view of the door-lock device of FIG. 4 with the lock pin in the extracted position.
Figure 6:
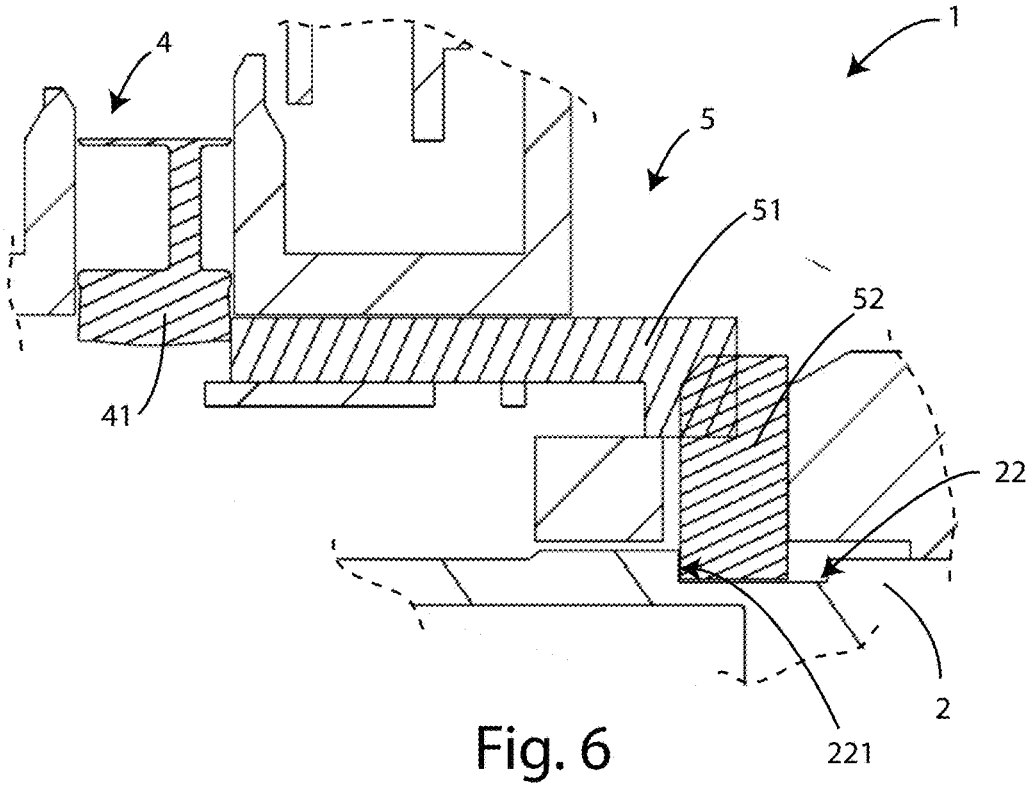
FIG. 6 shows a schematic view of the door-lock device of FIG. 4 with a safety pin inserted in a groove.

Referring to FIGS. 4-6, the operating sequence of the door-lock device 1 according to the present invention is observed.

In particular, in FIG. 4 we observe the position assumed by the safety slider 51 with respect to the blocking pin 41, when the latter is in the unlocked position. In this case, the blocking slider 32 is in the retracted position.

In FIG. 5, however, the blocking pin 41 is seen in the locked position while the blocking slider 32 (which is not visible in the figure) is in the extracted position, not stressed.

Finally, in FIG. 6 it is observed that the safety pin 52 is inserted into the groove due to a stress from the prong N of the blocking slider 32 (which is not visible in the figure) and therefore of the safety slider 51. In this case the safety slider 51 abuts with the blocking pin 41, without excessive stress, thanks to the fact that the safety pin 52 abuts the wall 221 of the groove 22.

In one embodiment, the safety member or pin 52 can be directly attached to the blocking slider 32. In this case, said safety pin 52 limits the sliding of the blocking slider 32.

Advantages

An advantage of the present invention is the fact that by means of the door-lock device according to the invention it is possible to free the opening of a door, limiting the risks of jamming or the blocking of the opening kinematics.

Another advantage of the present invention is that it allows the creation of an economical door-lock device.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A door-lock device for a door of a household appliance having a door and a prong (N) associated with said door, wherein said door-lock device comprises:

a containment casing;

a blocking assembly arranged in said containment casing, which includes a blocking slider, constrained to slide between a retracted position and an extracted position, wherein said blocking slider is arranged to interfere with the prong (N) when the door is opened; and an electric module comprising a blocking pin, wherein said blocking pin is capable of assuming an unlocking position on command, and a blocking position to hold said blocking slider in said blocking position;

wherein the door-lock device comprises a damping assembly having a safety member or pin, arranged so as to limit the sliding of said blocking slider when said blocking slider is strained by said prong (N) to move from said extracted position to said retracted position and said blocking pin is in said blocked position, wherein said damping assembly comprises a safety slider constrained to said blocking slider, and arranged so as to interfere with said blocking pin when the blocking slider is forced by said prong (N) to pass from said extracted position to said retracted position, and wherein said safety pin is constrained to said safety slider.

2. The door-locking device according to claim 1, wherein said safety slider comprises a tooth, said containment casing comprises a groove, and said safety pin has a sliding guide, in which said tooth of said safety slider is constrained to slide, wherein, when said blocking slider is urged by said prong (N), said safety pin is moved so as to interfere with said groove to block the sliding of said blocking slider.

3. The door-lock device according to claim 2, wherein said groove has a side abutment wall, and wherein said safety pin blocks the sliding of said blocking slider by abutting on said side abutment wall.

4. The door-lock device according to claim 1, wherein said damping assembly comprises a returning member interposed between said blocking slider and the safety pin, to oppose the movement of said safety pin when said blocking slider is strained by said prong (N) to pass from said extracted position to said retracted position.

5. The door-lock device according to claim 1, wherein said blocking assembly comprises a rotating hook intended to engage with said prong (N) associated with the door of said household appliance when said blocking slider is in said extracted position.

6. A household appliance, comprising:

a door having an associated prong (N), a logic control unit (U), and a door-lock device according to claim 1, wherein said logic control unit (U) is operatively connected to said electric module of said door-lock device to actuate said blocking pin on command.

7. The household appliance according to claim 6, comprising a drum for containing clothes to be washed, wherein said door is capable of closing said drum.

* * * * *